US010228121B2

(12) United States Patent
Kim et al.

(10) Patent No.: US 10,228,121 B2
(45) Date of Patent: Mar. 12, 2019

(54) LED FLAT LIGHTING DEVICE

(71) Applicant: DMLITE CO., LTD., Seoul (KR)

(72) Inventors: Jung Sik Kim, Seoul (KR); Yu Jin Jo, Seoul (KR); Jun Hoon Park, Seoul (KR)

(73) Assignee: DMLITE CO., LTD., Seoul (KR)

( * ) Notice: Subject to any disclaimer, the term of this patent is extended or adjusted under 35 U.S.C. 154(b) by 572 days.

(21) Appl. No.: 13/978,775

(22) PCT Filed: Dec. 31, 2012

(86) PCT No.: PCT/KR2012/011862

§ 371 (c)(1),
(2) Date: Jul. 9, 2013

(87) PCT Pub. No.: WO2014/069717

PCT Pub. Date: May 8, 2014

(65) Prior Publication Data

US 2014/0226344 A1 Aug. 14, 2014

(30) Foreign Application Priority Data

Oct. 30, 2012 (KR) ..... 10-2012-0121355

(51) Int. Cl.

| | |
|---|---|
| ***F21V 15/01*** | (2006.01) |
| ***F21K 99/00*** | (2016.01) |
| ***F21V 29/83*** | (2015.01) |
| ***F21V 29/507*** | (2015.01) |

(Continued)

(52) U.S. Cl.
CPC ..... *F21V 29/83* (2015.01); *F21V 29/507* (2015.01); *F21Y 2105/10* (2016.08); *F21Y 2115/10* (2016.08)

(58) Field of Classification Search
CPC ..... F21V 29/83; F21V 29/507
See application file for complete search history.

(56) References Cited

U.S. PATENT DOCUMENTS 4,992,918 A * 2/1991 Shioiri ..... F21L 14/00 362/368
5,146,392 A * 9/1992 Kasboske ..... F21V 21/005 362/362

(Continued)

FOREIGN PATENT DOCUMENTS

JP 2010526416 7/2010
JP 2011146243 7/2011

(Continued)

OTHER PUBLICATIONS

International Search Report—PCT/KR2012/011862 dated Jul. 12, 2013.

*Primary Examiner* — Anh Mai
*Assistant Examiner* — Zachary J Snyder
(74) *Attorney, Agent, or Firm* — Novick, Kim & Lee, PLLC; Jae Youn Kim

(57) ABSTRACT

The present invention relates to an LED flat lighting device which facilitates heat emission, while being used in a small and medium imaging device for taking a picture or an image, and which is also formed into a thin and small size. The LED flat lighting device includes an LED module which emits light toward the front side; a flat-shaped first housing which is spaced apart from the LED module so as to form a convection part for discharging heat generated from the LED module; a fixing member which couples the LED module and the first housing to each other; and a circuit board which controls the LED module and which is installed at the first housing spaced apart from the LED module so that the convection part is interposed therebetween.

11 Claims, 16 Drawing Sheets

(51) Int. Cl.
*F21Y 105/10* (2016.01)
*F21Y 115/10* (2016.01)

(56) References Cited

U.S. PATENT DOCUMENTS

| | | | | |
|---|---|---|---|---|
| 6,199,987 | B1 * | 3/2001 | Haba | G02B 27/283 348/E5.139 |
| 6,813,853 | B1 * | 11/2004 | Tucker | G09F 9/33 340/815.45 |
| 2004/0228133 | A1 * | 11/2004 | Tsao | F21V 21/06 362/418 |
| 2008/0266206 | A1 * | 10/2008 | Nelson | G09F 9/33 345/1.3 |
| 2010/0265722 | A1 * | 10/2010 | Sohn | F21V 15/01 362/311.02 |
| 2010/0296287 | A1 * | 11/2010 | Huang | F21V 15/013 362/249.02 |
| 2012/0275156 | A1 * | 11/2012 | Cheng | F21K 9/00 362/249.02 |
| 2012/0287367 | A1 * | 11/2012 | Zhang | H05K 5/02 349/58 |

FOREIGN PATENT DOCUMENTS

| | | |
|---|---|---|
| JP | 2012500457 | 1/2012 |
| JP | 2012022875 | 2/2012 |
| KR | 1020100048320 | 5/2010 |
| KR | 1020100074374 | 7/2010 |
| KR | 1020110012284 | 2/2011 |
| WO | 2008137732 | 11/2008 |
| WO | 2010066117 | 6/2010 |

* cited by examiner (a)

(b)

(a)

(b)

(a)

(b)

LED FLAT LIGHTING DEVICE

TECHNICAL FIELD

The present invention relates to an LED flat lighting device, and more particularly, to an LED flat lighting device which facilitates heat emission, while being used in a small and medium imaging device for taking a picture or an image, and which is also formed into a thin and small size.

BACKGROUND ART

LEDs that are replacing traditional lamps such as an incandescent lamp are spotlighted due to its small size, light weight, low thermal radiation, semi-permanence, fast response characteristic, pulse operation ability, optical power control characteristic and the like.

However, in order to maintain the semi-permanent usage guarantee and the optical characteristic such as brightness, it is essential to solve the thermal radiation problem.

In Korean Patent Laid-Open Publication No. 10-2010-0074374, there is disclosed "an LED lighting device with a heat sink".

In the LED lighting device with the heat sink, heat generated from an LED mounted on a circuit board is transferred to the heat sink and then discharged through a heat sinking member protruded to one side of the heat sink.

However, the LED lighting device may be suitable for a general illuminator such as a streetlight, but unsuitable for a photoflood lamp.

In Korean Patent Laid-Open Publication No. 10-2011-0012284, there is disclosed "an LED lighting device for broadcasting and photographing".

FIG. 1 is a perspective view of a conventional LED lighting device, and FIG. 2 is a cross-sectional view of the conventional LED lighting device.

As shown in FIGS. 1 and 2, the conventional LED lighting device includes a multi-chip LED 110, a cooling part 120, a power part 130 and a housing 140.

In the multi-chip LED 110, a block having a groove is formed in plural and multiple lines at a front side of a heat sink forming a heat diffusion plate, and multiple LEDs bonded in each block emit light according to their color temperatures.

In the cooling part 120, an injection jacket 121 which injects cooled fluid to the heat diffusion plate is integrally formed with a rear face of the heat sink, and a fluid pipe 125 in which fluid is circulated and cooled is connected to the injection jacket 121, thereby performing the cooling operation in an injected fluid cooling manner.

The power part 130 includes a power supplying part 131 for supplying power to the multi-chip LED 110 and the cooling part 120, and a control board 132 for controlling them.

These elements are covered with the housing 140, thereby forming the LED lighting device for broadcasting and photographing 100.

However, in case of the LED lighting device for broadcasting and photographing, since the cooling part 120 and the power part 130 have a large volume, a whole size thereof is also increased.

If the size of the LED lighting device is increased, it is difficult to move or transport it and a large space is also needed.

Thus, there is a necessity for a new LED lighting device which can efficiently perform the cooling operation and also has a slim structure.

DISCLOSURE

Technical Problem

An object of the present invention is to provide an LED flat lighting device in which a heat emission space is formed between an LED module and a circuit board installed in a flat housing in order to increase cooling effect, and also which has a slim structure.

Technical Solution

To achieve the object of the present invention, the present invention can provide an LED flat lighting device, including an LED module which emits light toward the front side; a flat-shaped first housing which is spaced apart from the LED module so as to form a convection part for discharging heat generated from the LED module; a fixing member which couples the LED module and the first housing to each other; and a circuit board which controls the LED module and which is installed at the first housing spaced apart from the LED module so that the convection part is interposed therebetween.

Preferably, the first housing is formed with a radiation hole which communicates the convection part with an outside of the first housing.

Preferably, an installing hole in which the fixing member is inserted is formed at an edge of the first housing, and a light transmission cover covering the LED module is installed at a front side of the first housing, and the fixing member includes a coupling part which is coupled to the first housing; a first installing part which is protruded to a front side of the coupling part so as to be disposed in the first housing and in which the LED modules are installed; and a second installing part which is protruded to a front side of the first installing part and in which the light transmission cover is installed.

Preferably, the LED flat lighting device further includes a finishing member which is installed at each corner portion of the first housing.

Preferably, the finishing member is branched and protruded into two sections in order to form protrusions and an insertion hole is formed at the corner portion of the first housing so as to be corresponding to the protrusions so that the protrusion is inserted therein.

Preferably, the LED flat lighting device further includes a second housing that the circuit board is installed therein, and multiple radiation fins are installed on an outer surface thereof, and the first housing is installed at a rear side thereof, wherein an opening portion communicated with the convection part is formed at a rear side surface of the first housing installed at the second housing, and a radiation pad is formed at the second housing so as to be inserted into the opening portion.

Preferably, the LED flat lighting device further includes a stand which is coupled with the fixing member installed at both sides of the first housing by using a fastening member in order to stand the first housing, wherein the stand is formed with a slot-shaped coupling hole, and the fastening member is movably inserted into the coupling hole so as to fix the first housing to the stand.

Preferably, the stand is bent to cover an upper or lower portion of the first housing, and the stand has an oval shape in section, and reinforcing protrusions are formed at the stand in a length direction of the stand.

Preferably, the LED flat lighting device further includes a bandoor which is installed at the first housing in order to control a diffusion range of light emitted from the LED module, wherein the bandoor is fixed to the first housing by using a captive screw.

Preferably, the LED flat lighting device according to claim 1, further includes a blade guide which is installed at the first housing and formed with one or more rail part opened in one direction; and a bandoor which is coupled to the rail part so as to control a diffusion range of light emitted from the LED module.

Preferably, the LED flat lighting device further includes a bracket which is coupled with an adapter for supplying power to the circuit board and disposed at a rear side of the first housing, wherein a rivet is provided at the first housing in which the bracket is installed, and one end of the bracket is formed with a rivet groove formed between the first housing and the rivet, and the other end thereof is fixed to the first housing by using a captive screw.

Preferably, the bracket is formed with a protruded part which is bent to wind a cable connected to the adapter.

Preferably, the LED flat lighting device further includes a rain cover which is installed at the first housing so as to cover the first housing, wherein the rain cover comprises a supporting frame which is detachably installed at an upper portion of the first housing; and a cover member which is coupled to an upper portion of the supporting frame so as to cover upper, rear and both side surfaces of the first housing.

Preferably, the supporting frame is foldable in a state of being separated from the first housing, and the supporting frame comprises a fixing frame; and a rotating frame which is hinged to both sides of the fixing frame so as to be rotated with respect to the fixing frame.

Advantageous Effects

According to the present invention as described above, the LED flat lighting device has an effect as follows:

Since the LED module is installed at the first installing part of the fixing member so as to be disposed in the flat first housing, it is possible to discharge the heat generated from the LED module and circuit board to the outside through the convection part formed between the circuit board and the LED module, thereby efficiently cooling the lighting device, and also it is possible to maintain the slim structure.

DESCRIPTION OF DRAWINGS

The above and other objects, features and advantages of the present invention will become apparent from the following description of preferred embodiments given in conjunction with the accompanying drawings, in which.

BEST MODE

Figure 1:
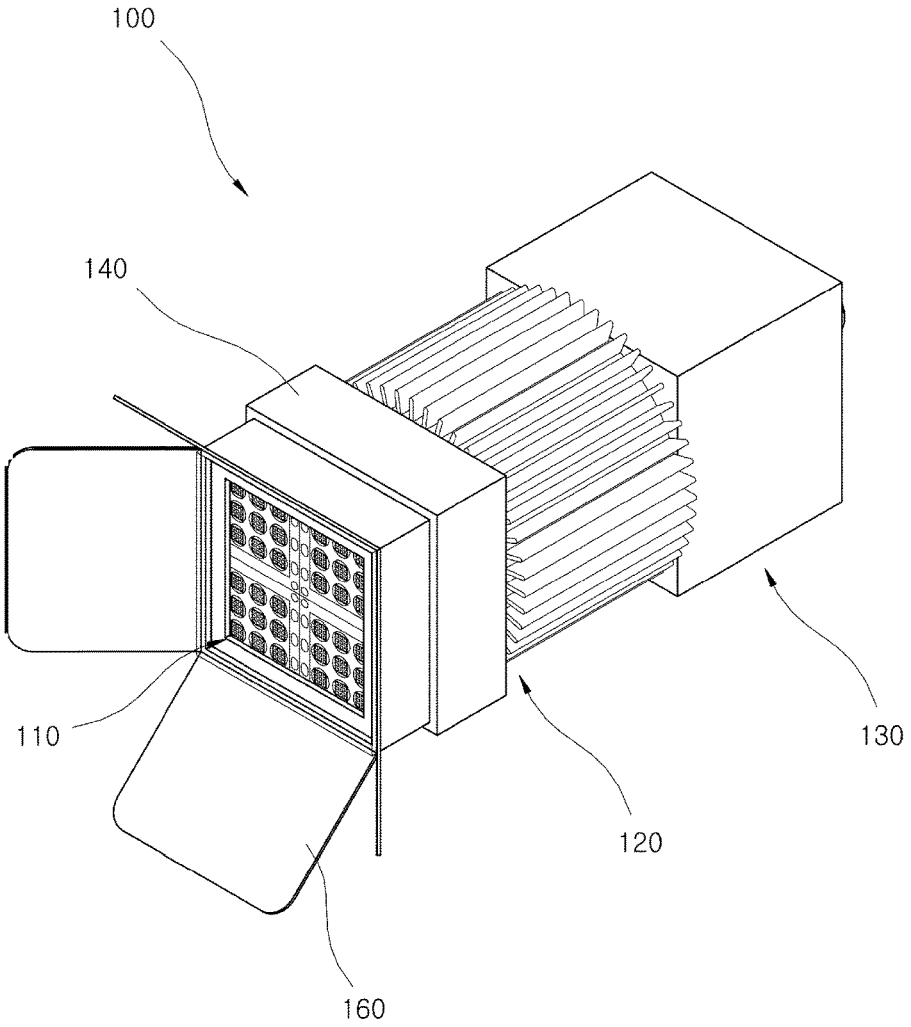
FIG. 1 is a perspective view of a conventional LED lighting device.

Hereinafter, the embodiments of the present invention will be described in detail with reference to accompanying drawings.

First Embodiment

As shown in FIGS. 3 to 11, an LED flat lighting device according to a first embodiment of the present invention includes a first housing 1, a second housing 2, a circuit board 21, a fixing member 3, a finishing member 4, an LED module 5, a bracket 6 and a stand 7.

Figure 3:
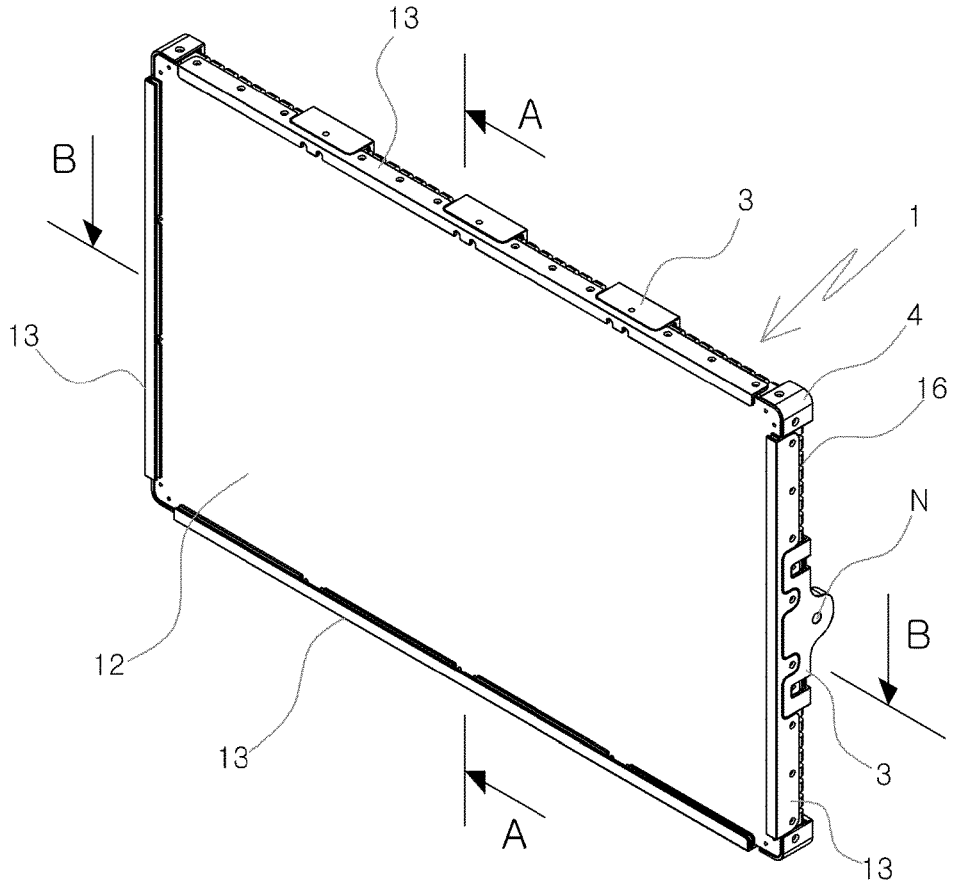
FIG. 3 is a perspective view of an LED flat lighting device according to a first embodiment of the present invention.
Figure 4:
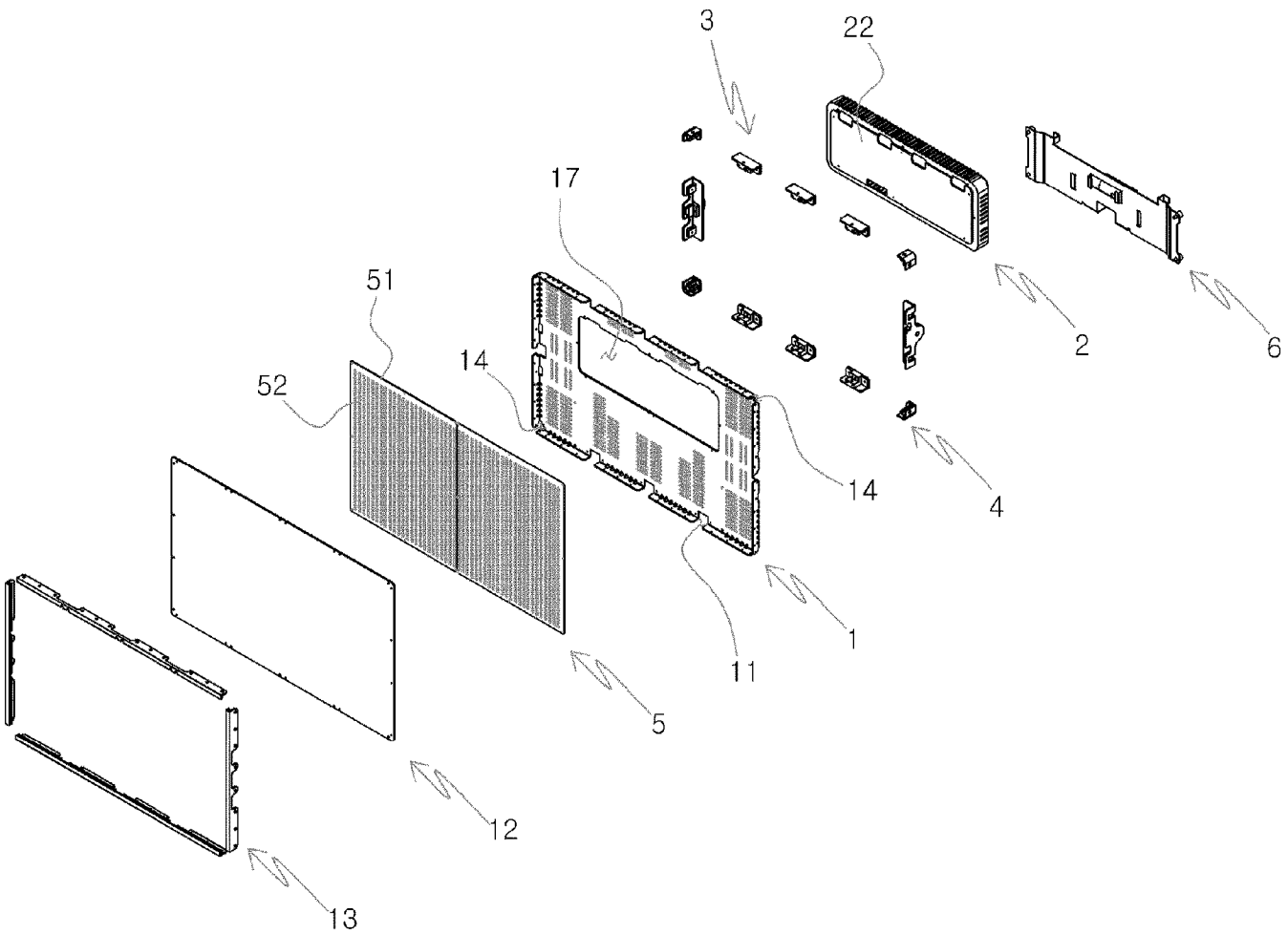
FIG. 4 is one directional exploded perspective view of the LED flat lighting device according to the first embodiment of the present invention.
Figure 5:
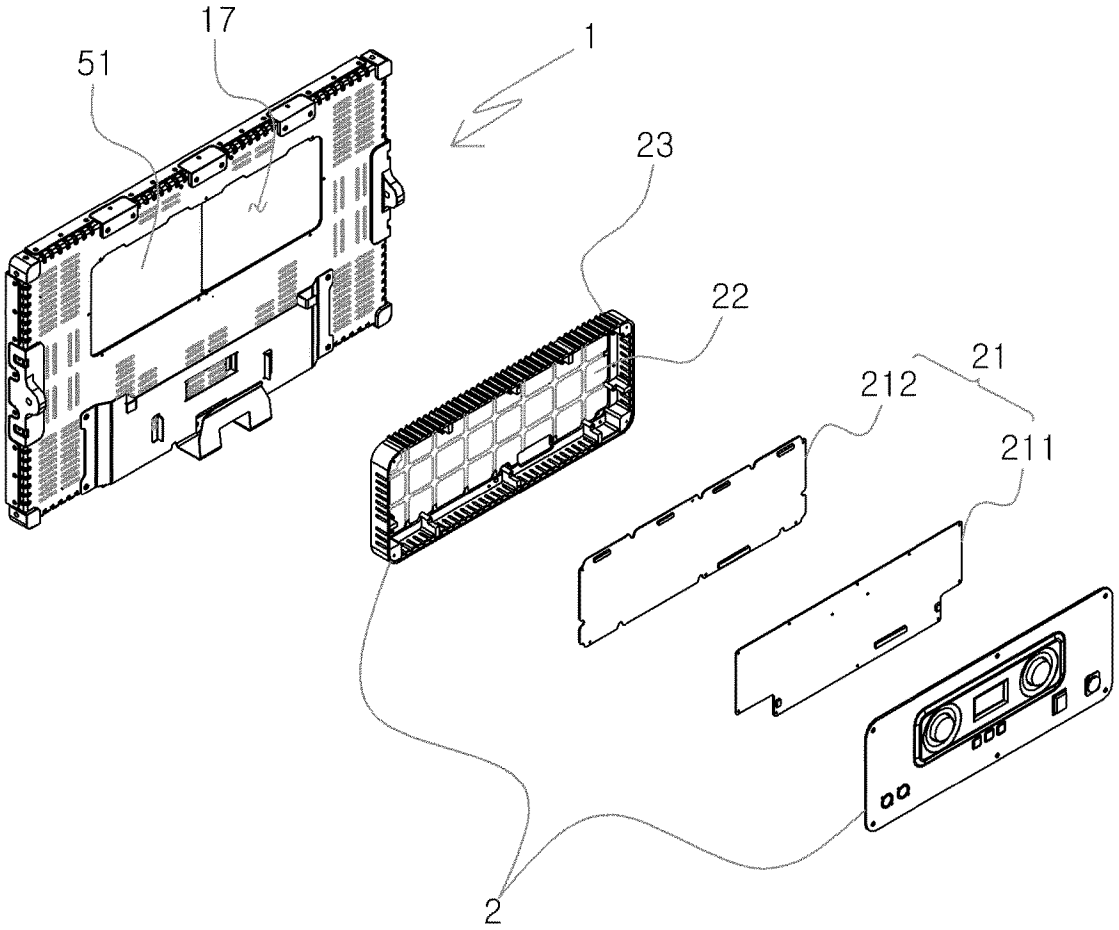
FIG. 5 is other directional exploded perspective view of the LED flat lighting device according to the first embodiment of the present invention.

As shown in FIGS. 3 to 5, the first housing 1 is formed into a flat shape, and the circuit board 21 is disposed at the rear side of the first housing 1.

As shown in FIG. 4, multiple installing holes 11 in which the fixing member 3 is inserted and installed are formed at the edge of the first housing 1, and the LED module 5 is disposed in the first housing 1, and then a light transmission cover 12 is installed at the front side of the first housing 1.

The first housing 1 is formed with the multiple installing holes 11.

The multiple installing holes 11 are formed at the edge of the first housing 1 so that the fixing member 3 is inserted.

A blade guide 13 may be installed at the first housing 1 coupled with the light transmission cover 12.

Figure 6:
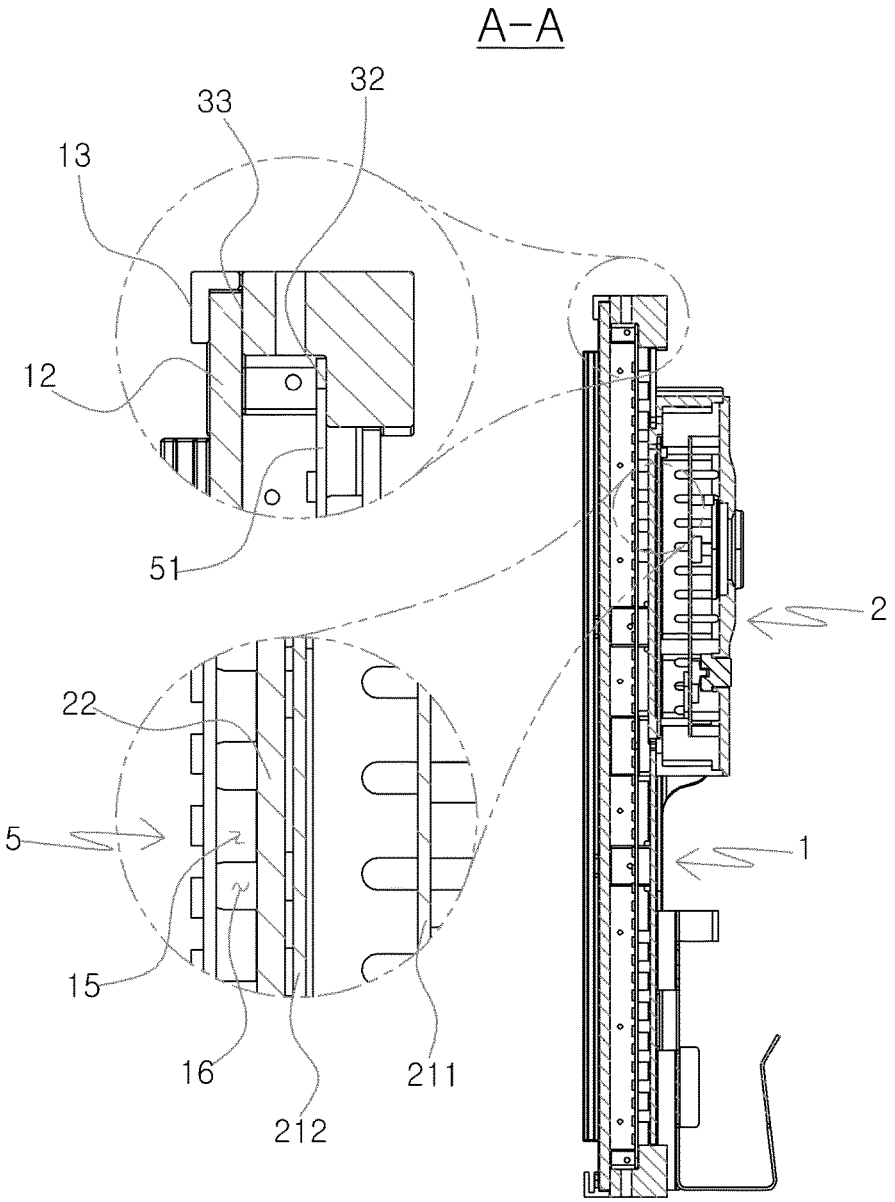
FIG. 6 is a cross-sectional view taken along a line A-A of FIG. 3.

As shown in FIG. 6, the blade guide 13 is installed at the side edge of the housing 1 and bent in order to cover the front edge portion of the light transmission cover 12, thereby preventing separation of the light transmission cover 12 from the first housing 1 and also preventing scratch of the light transmission cover 12.

And as shown in FIG. 4, the first housing 1 is formed with multiple inserting holes 14.

The inserting holes 14 are formed at the corner portions of the first housing 1 so as to be corresponding to protrusions 41 formed at the finishing member 4, and thus the protrusions 41 of the finishing member 4 are inserted into the inserting holes 14.

Detailedly, the first housing 1 is formed into a rectangular shape, and the inserting holes 14 are formed at the corner portions of the first housing 1.

However, the shape of the first housing 1 is not limited to this, and it can be variously modified within the technical scope of the present invention.

And as shown in FIG. 6, a convection part 15 is formed between the LED module 5 disposed in the first housing 1 and the rear side surface of the first housing 1, on which the second housing 2 is installed. And a radiation hole 16 is formed at the first housing 1 having the convection part 15 in order to communicate the convection part 15 with an outside of the first housing 1.

Thus, air heated at the convection part 15 is discharged to the outside of the first housing 1 through the radiation hole 16, and also cool external air is introduced into the convection part 15 through the radiation hole 16.

That is, heat generated from the circuit board 21 and the LED module 5 is transferred to the convection part 15 so as to heat the air in the convection part 15, and then while the heated air is discharged to the outside of the first housing 1 through the radiation hole 16, the cool external air is introduced into the convection part 15 so as to absorb the heat generated from the circuit board 21 and the LED module 5, thereby cooling the circuit board 21 and the LED module 5.

As described above, since the convection part 15 is formed between the LED module 5 and the circuit board 21 in order to efficiently discharge the heat generated from the circuit board 21 and the LED module 5 and thus to cool the circuit board 21 and the LED module 5, and also the heat generated from the circuit board 21 and the LED module 5 is transferred mutually, thereby preventing overheat of the circuit board 21 and the LED module 5.

An opening portion 17 communicated with the convection part 15 is formed at the rear side surface of the first housing 1.

The second housing 2 is installed at the rear side surface of the first housing 1 having the opening portion 17 in order to cover the opening portion 17.

As shown in FIG. 5, the circuit board 21 for controlling the LED module 5 is installed in the second housing 2, and the second housing 2 is disposed at the rear side of the first housing 1.

The circuit board 21 includes a main PCB 211 and a control PCB 212 which are installed at the rear side of the housing 2.

A radiation pad 22 is formed at the second housing 2 so as to be inserted into the opening portion 17, and multiple radiation fins 23 are formed on the outer surface of the second housing 2.

Detailedly, the control PCB 212 is disposed in the second housing 2 so as to be adjacent to the radiation pad 22, and the main PCB 211 is disposed to be spaced apart from the control PCB 212.

Therefore, heat generated from the main PCB 211 and the control PCB 212 is efficiently discharged to the outside of the second housing 2 through the radiation pad 22 and the radiation fin 23.

Particularly, the radiation pad 22 can maximize the cooling effect of the control PCB 212 through heat transfer with the control PCB 212.

Herein, the heat transferred to the radiation pad 22 is transferred again to the convection part 15 so as to heat the air in the convection part 15, and the heated air is discharged to the outside of the first housing 1 through the radiation hole 16.

The fixing member 3 is provided in plural, inserted into the installing holes 11 and thus installed at the first housing 1.

Figure 7:
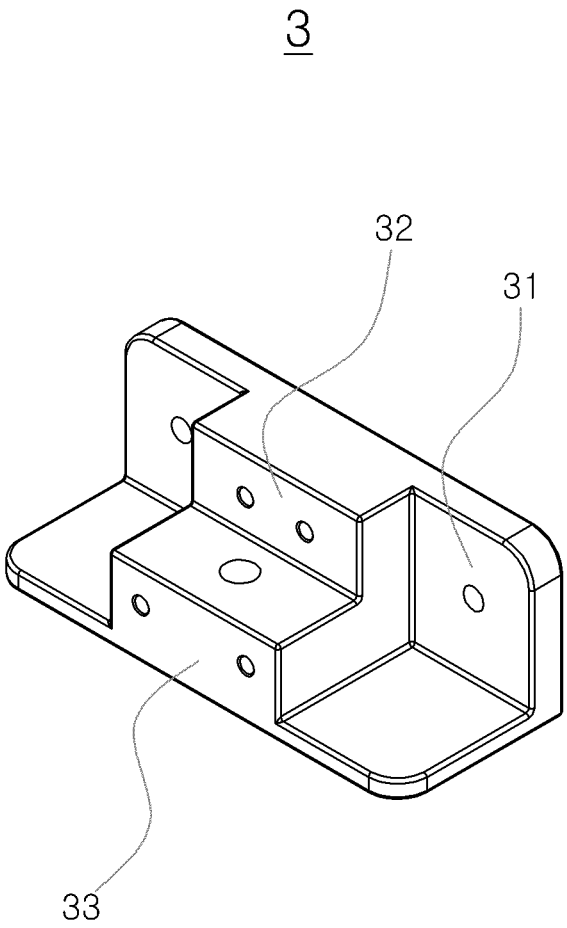
FIG. 7 is a perspective view of a fixing member according to the first embodiment of the present invention.

Detailedly, as shown in FIG. 7, the fixing member 3 is formed with a coupling part 31, a first installing part 32 and a second installing part 33 which are formed to be stepped.

The coupling part 31 is fixed to the first housing 1 having the installing hole 11.

The first installing part 32 is formed to be protruded to the front side of the coupling part 31, inserted into a coupling hole 71 and disposed in the first housing 1.

The LED module 5 is installed at the first installing part 32.

The second installing part 33 is formed to be protruded to the front side of the first installing part 32, inserted into the coupling hole 71 and disposed in the first housing 1.

The light transmission cover 12 is installed at the second installing part 33.

In the fixing member 3, as shown in FIGS. 6 and 7, since the coupling part 31, first installing part 32 and second installing part 33 are formed to be stepped with respect to each other, the LED module 5 and the light transmission cover 12 can be facilely fixed in the first housing 1 so as to be spaced apart from each other, and the convection part 15 is formed to be spaced apart from the rear surface of the first housing 1.

And as shown in FIG. 3, one of the multiple fixing members 3, which is fixed to both sides of the first housing 1, is formed with a screw hole N so that the stand 7 can be installed.

A fastener T is fastened in the screw hole N so that the stand 7 is coupled with the fixing members 3 fixed to both sides of the first housing 1.

The detailed description thereof will be described later together with the stand 7.

The finishing member 4 is installed at each corner portion of the first housing 1.

Figure 8:
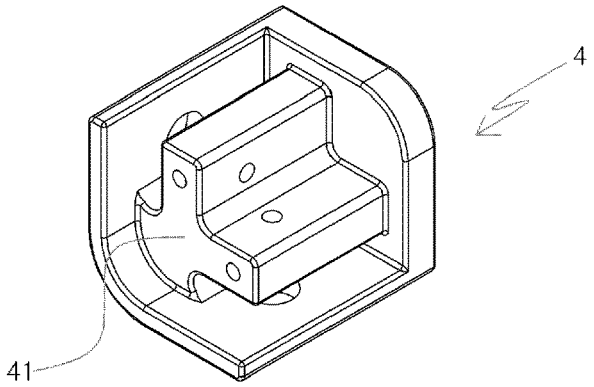
FIG. 8 is a perspective view of a finishing member according to the first embodiment of the present invention.
Figure 8:
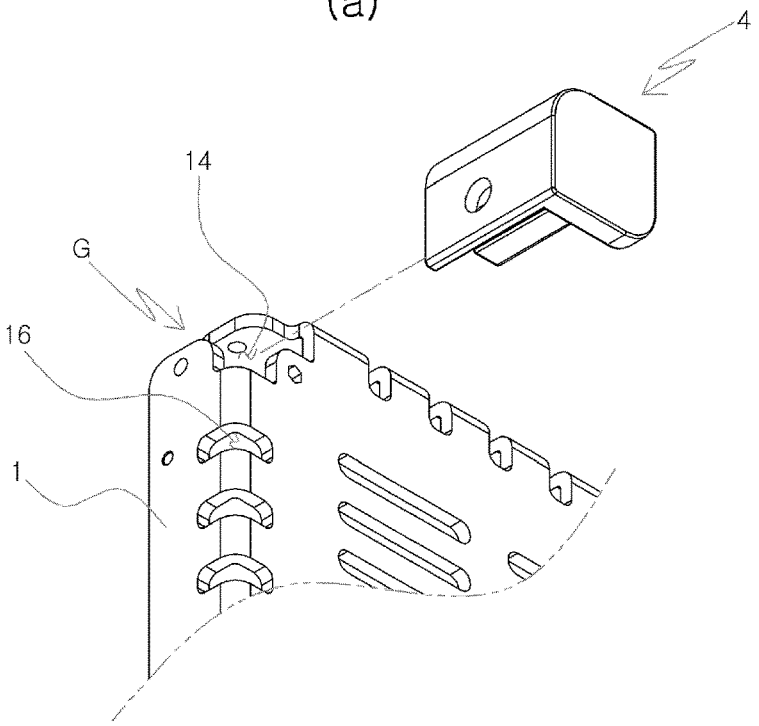

As shown in FIG. 8, the finishing member 4 is branched and protruded into two sections in order to form protrusions 41 and then inserted into an insertion hole 14.

A gap G is formed at the corner portion of the first housing 1 formed by a bending operation when manufacturing the first housing 1.

Therefore, the finishing member 4 is installed at the corner portion of the first housing 1 in order to reinforce the strength of the first housing 1 and also to cover the outer surface thereof.

The LED module 5 includes the LED PCB 51 and multiple LEDs 52 installed in the LED PCB 51.

The LED module 5 is installed at the fixing member 3 and disposed in the first housing 1 so as to emit light to the front side of the first housing 1.

Detailedly, the LED module 5 is disposed at the first installing part 32 so as to be spaced apart from the rear side surface of the first housing 1 that the circuit board 21 is disposed at the rear side thereof and thus to form the convection part 15 between the LED module 5 and the circuit board 21.

Therefore, as described above, the heat generated from the LED module 5 and the circuit board 21 is not directly transferred to each other, but discharged to the convection part 15, and then discharged to the outside of the first housing 1 through the radiation hole 16.

An adapter for supplying power to the circuit board 21 is coupled to the bracket 6, and the bracket 6 is installed at the rear side of the first housing 1.

Figure 9:
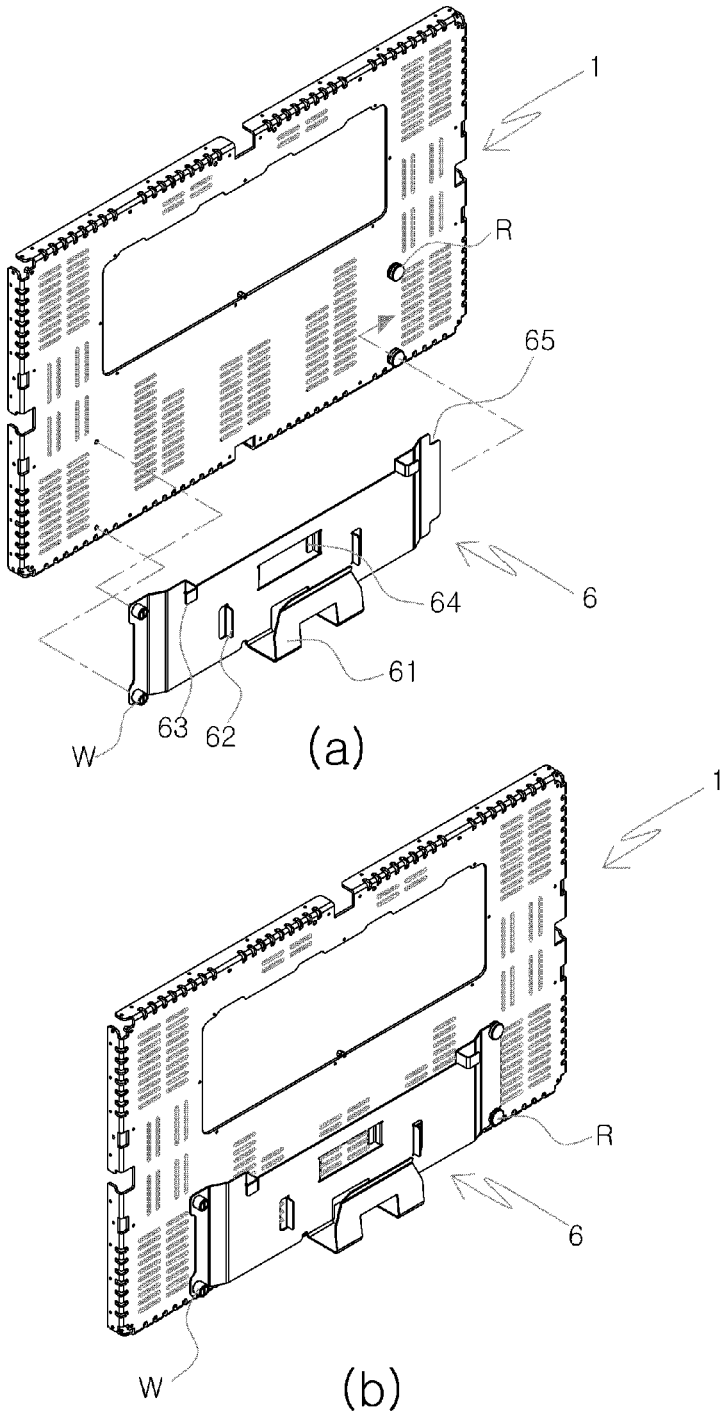
FIG. 9 is a view showing a coupling state of a bracket according to the first embodiment of the present invention.

As shown in FIG. 9, the bracket 6 is formed with a clip part 61 which is protruded to the rear side of the bracket 6 and then bent in order to fix the adapter, and then a guide part 62 is formed at both sides of the clip part 61 in order to facilely receive the adapter.

Further, a protruded part 63 for winding a cable connected to the adapter is formed at the bracket 6.

The protruded parts 63 formed at left and right sides are formed to be bent in opposite directions.

And a flexural prevention supporting portion 64 for preventing deformation of the bracket 6 is formed at an opposite surface to the surface on which the clip part 61 is formed.

A rivet groove 65 is formed at one end of the bracket 6 (a right end in FIG. 9).

A rivet R is provided at the first housing 1 in which the bracket 6 is installed, so that a portion of the bracket 6, in which the rivet groove 65 is formed, is disposed between the first housing 1 and the rivet R.

The other end of the bracket 6 is fixed to the first housing 1 by a captive screw W.

In case of the captive screw W which is a kind of bolt fastener, it can be facilely and repeatedly fastened and released, and also since it is not separated from the bracket 6 even after being released, there is no need to be apprehensive of loss.

In some cases, the bracket 6 may be fastened to the first housing 1 using only the captive screw W without forming the rivet groove 65.

The stand 7 is coupled to the first housing 1 in order to stand it.

More detailedly, as shown in FIG. 10*a*, both ends of the stand 7 are fixed to both sides of the first housing 1 by using a fastener T.

The stand 7 is formed to be bent, thereby covering an upper or lower portion of the housing 1.

The stand 7 may be directly coupled to the first housing 1, or may be coupled to the first housing 1 through the fixing member 3 installed at both sides of the first housing 1, as described in the embodiment.

The fastener T is a bolt, a screw or the like, and fastened into the screw hole N formed in the fixing member 3.

The coupling hole 71 is formed at the both ends of the stand 7 coupled to both sides of the first housing 1 so that the fastener T is inserted therein.

The coupling hole 1 is formed into a slot shape so that a position of the fastener T inserted into the coupling hole 71 is controlled.

That is, as shown in FIG. 10*b*, since it is possible to control the position of the fastener T inserted into the coupling hole 71, the center of gravity of the first housing 1 and stand 7 which are mutually coupled by the fastener T can be also controlled, and thus the first housing 1 can be stood in balance.

If necessary, a standing angle of the first housing 1 is controlled in a desired direction, and then the first housing 1 is fixed to the stand 7 by using the fastener T.

Figure 10:
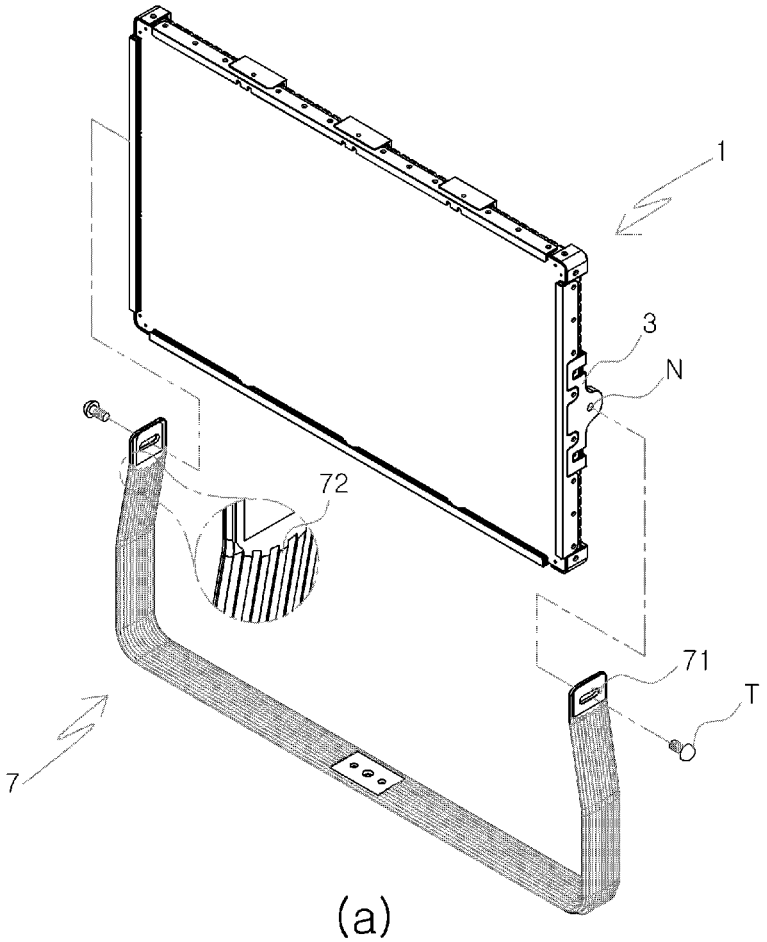
FIG. 10 is a view showing a coupling state between a first housing and a stand according to the first embodiment of the present invention.
Figure 10:
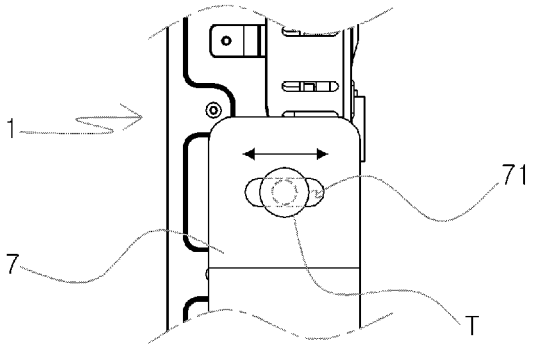
Figure 11:
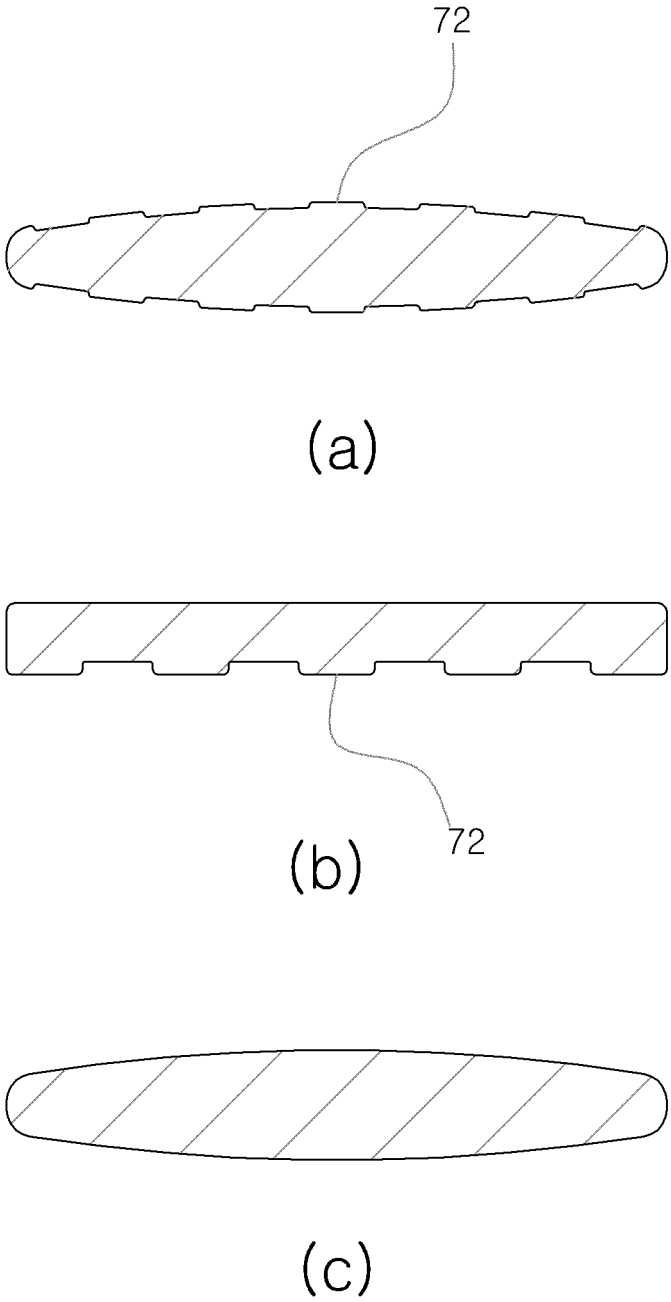
FIG. 11 is a cross-sectional view of the stand according to the first embodiment of the present invention.

As shown in FIGS. 10 and 11*a*, the stand 7 has an oval shape in section, and reinforcing protrusions 72 are formed in its length direction.

Since the first housing 1 is supported and stood by using the stand 7 as described above, a load applied to the stand 7 can be dispersed, it is possible to prevent deformation of the stand 7 and also to stably stand the first housing 1.

As shown in FIGS. 11*b* and 11*c*, the stand 7 may have only an oval shape, or a rectangular shape having the reinforcing protrusions 72, or other various shapes in section.

As described above, since the LED module 5 is installed at the first installing part 32 of the fixing member 3 and then disposed in the flat first housing 1, the heat generated from the LED module 5 and the circuit board 5 is discharged to the outside through the convection part 15 formed between the circuit board 21 and the LED module 5 which are disposed at the rear side of the first housing 1 without heat transfer with each other, and thus it is possible to efficiently cool the lighting device and have a slim structure.

Second Embodiment

An LED flat lighting device according to the second embodiment has the same configuration as that of the first embodiment except a bandoor. The description will be concentrated upon the bandoor.

Figure 12:
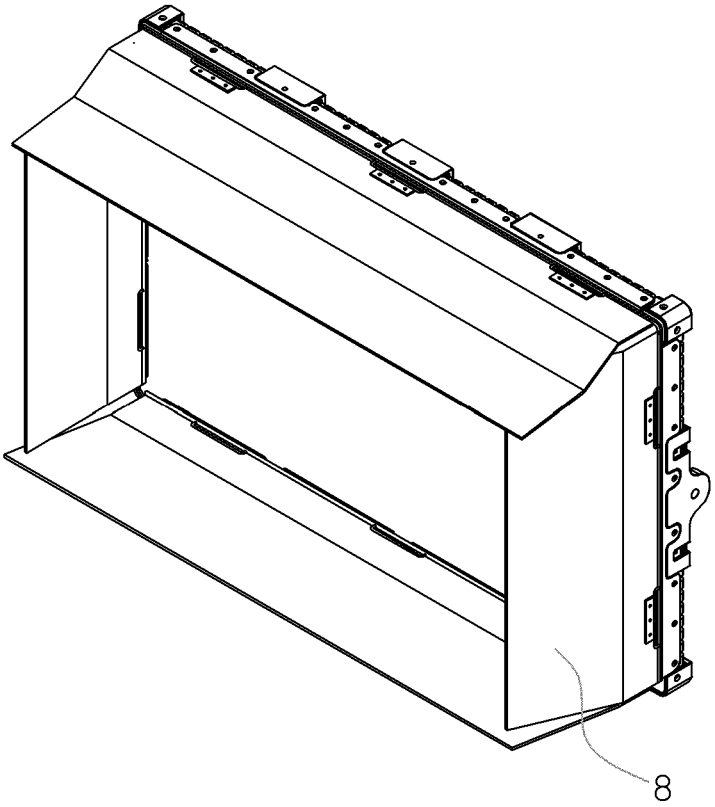
FIG. 12 is a view showing a state that a bandoor is coupled to an LED flat lighting device according to a second embodiment of the present invention.
Figure 13:
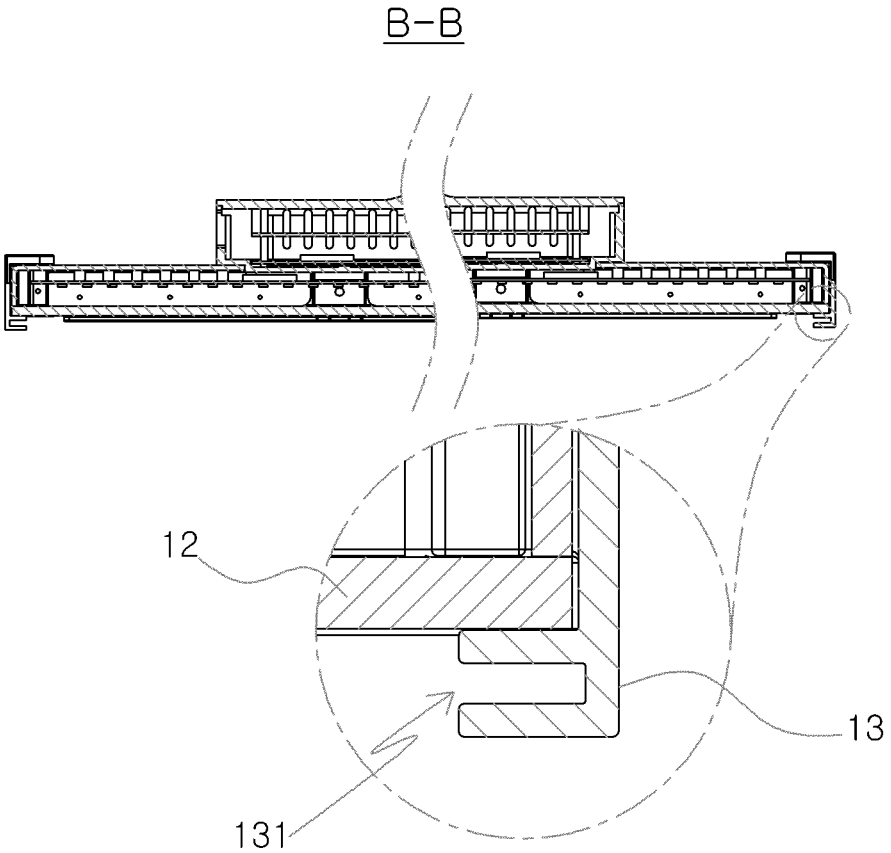
FIG. 13 is a cross-sectional view taken along a line B-B of FIG. 3.
Figure 13:
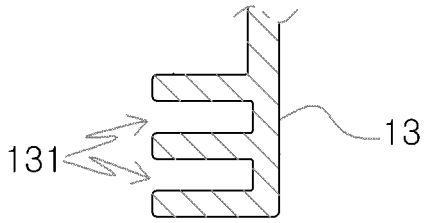

As shown in FIGS. 12 and 13, the LED flat lighting device according to the second embodiment includes a first housing 1, a second housing 2, a circuit board 21, a fixing member 3, a finishing member 4, an LED module 5, a bracket 6, a stand 7 and a bandoor 8.

Since the first housing 1, second housing 2, circuit board 21, fixing member 3, finishing member 4, LED module 5, bracket 6 and stand 7 are the same as in the first embodiment, the description thereof will be omitted.

Figure 2:
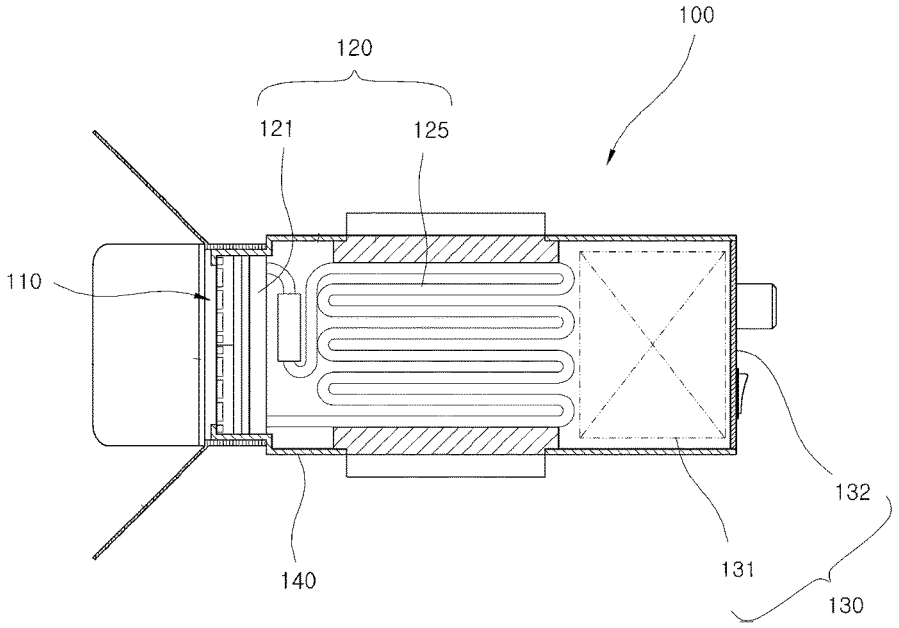
FIG. 2 is a cross-sectional view of the conventional LED lighting device.

The bandoor 8 is installed at the first housing 1 in order to control a diffusion range of light emitted from the LED module 5. As shown in FIGS. 1 and 2, the bandoor 8 (reflecting mirror: 180) is also provided in "the conventional LED lighting device for broadcasting and photographing".

The bandoor 8 is fixed to the blade guide 13 which is installed at the first housing 1 by using the captive screw W.

The captive screw W is a fastening member T which is integrally formed with the bandoor 8, and thus it can be facilely and repeatedly fastened and released, and also since it is not separated from the bandoor 8 even after the first housing 1 and bandoor 8 are released, there is no need to be apprehensive of loss.

Further, as shown in FIG. 13*a*, instead of the captive screw W, a rail part 131 which is opened toward an inside of the blade guide 13 installed at the side edge of the first housing is formed, and the bandoor 8 is inserted into the rail part 131 and then fixed to the first housing 1.

Furthermore, as shown in FIG. 13*b*, the rail part 131 may be formed into a dual structure so that the bandoor 8 and a gel filter or the like can be simultaneously fixed to the first housing 1.

Third Embodiment

An LED flat lighting device according to the third embodiment has the same configuration as that of the first embodiment except a rain cover. The description will be concentrated upon the rain cover.

Figure 14:
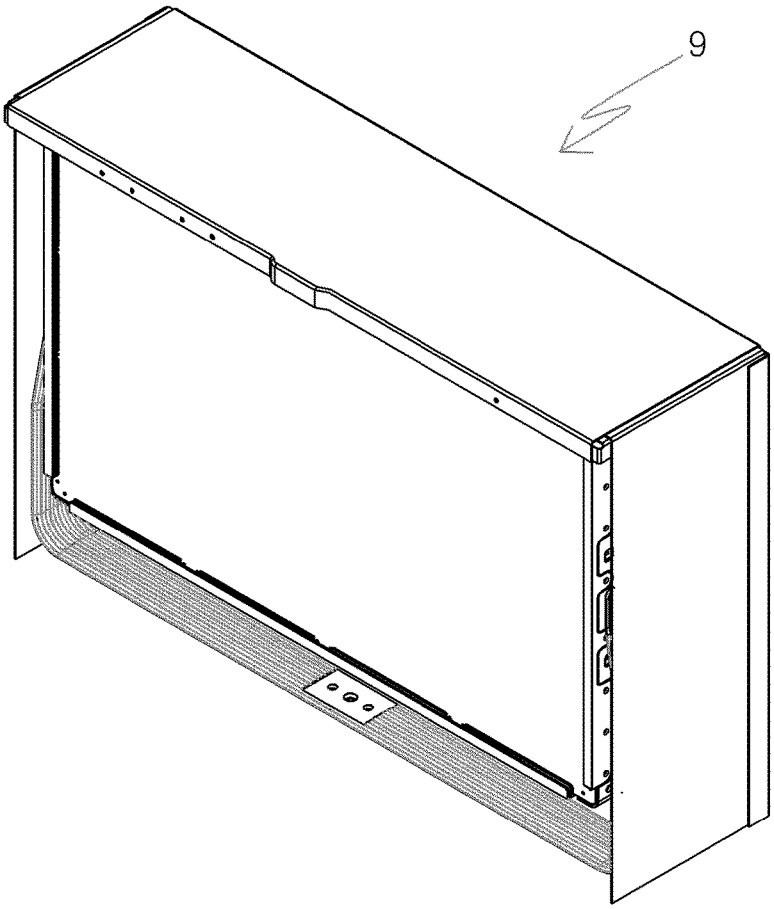
FIG. 14 is a view showing a stat that a rain cover is coupled to an LED flat lighting device according to a third embodiment of the present invention.
Figure 15:
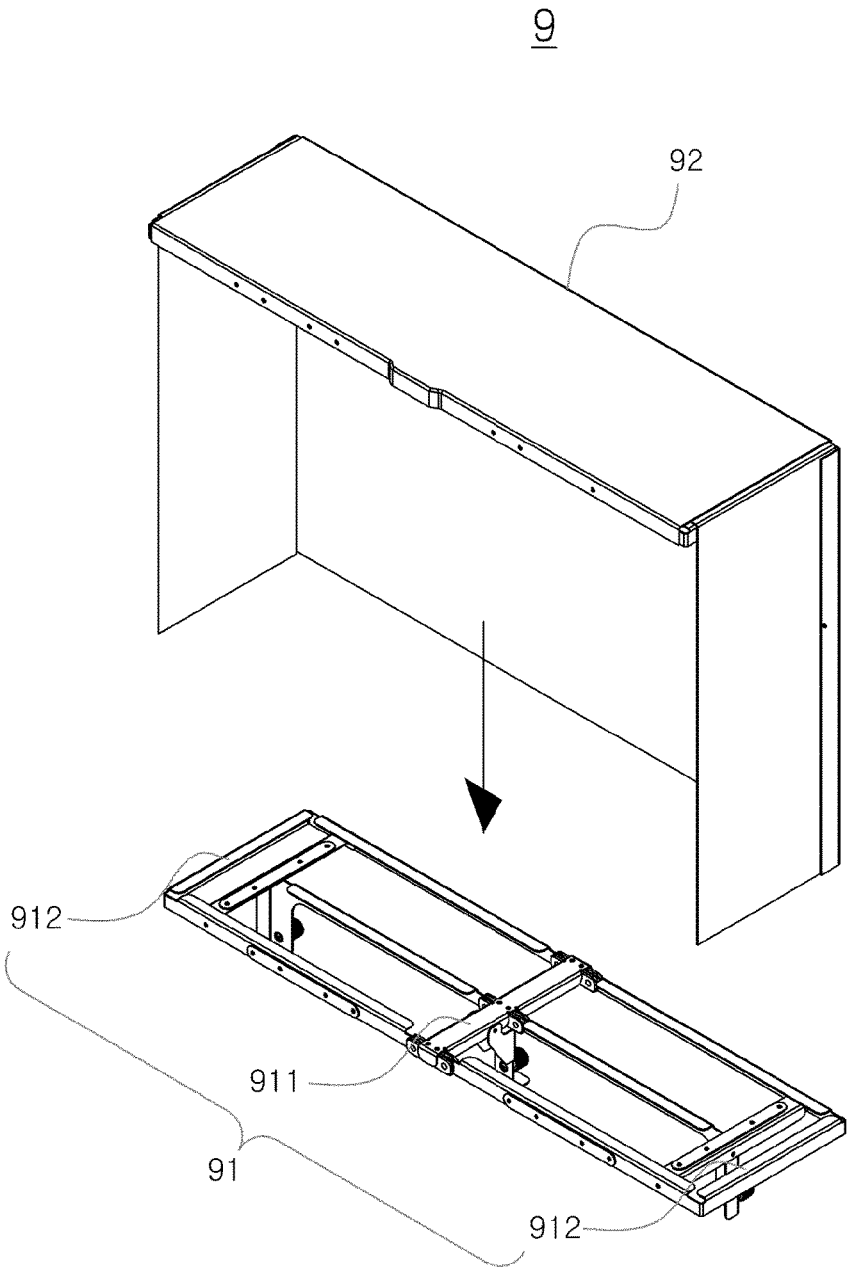
FIG. 15 is an exploded perspective view of the rain cover according to the third embodiment of the present invention.
Figure 16:
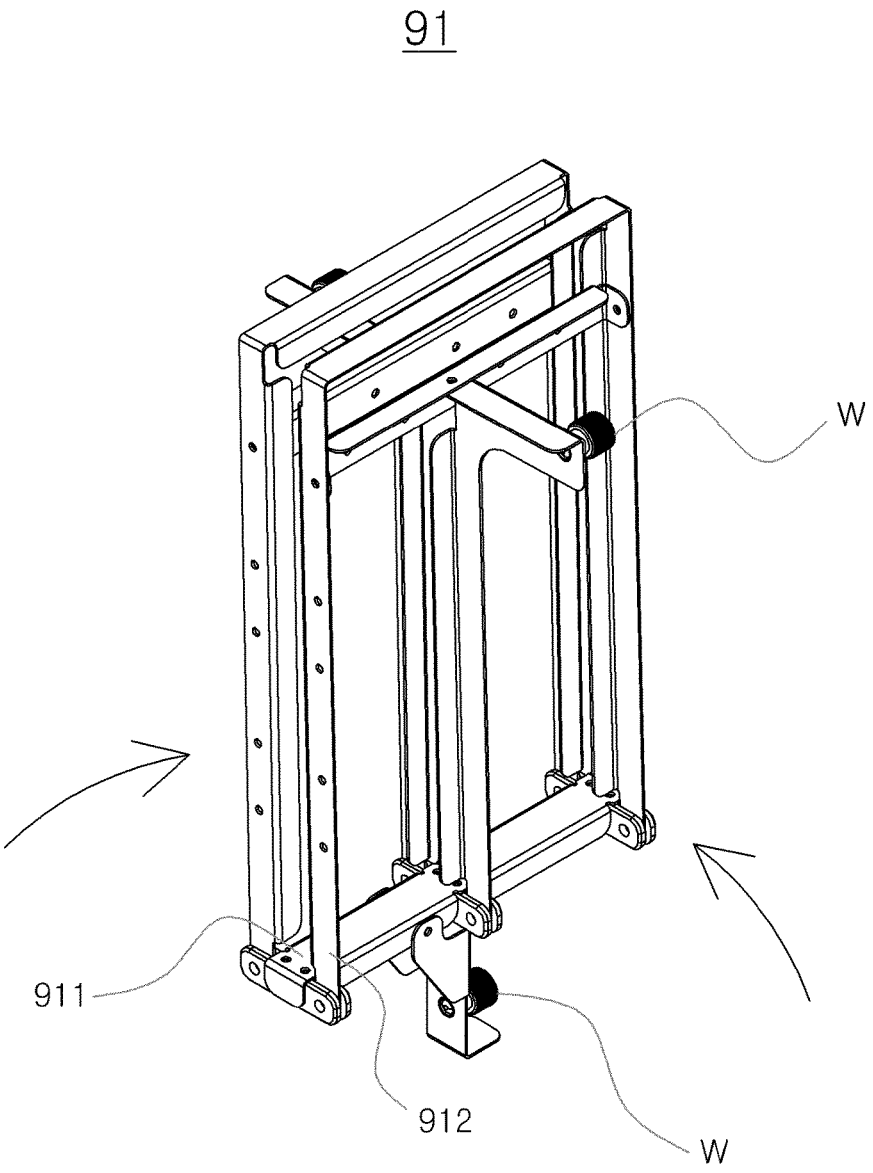
FIG. 16 is a view a state that a supporting frame is folded according to the third embodiment of the present invention.

As shown in FIGS. 14 to 16, the LED flat lighting device according to the second embodiment includes a first housing 1, a second housing 2, a circuit board 21, a fixing member 3, a finishing member 4, an LED module 5, a bracket 6, a stand 7 and a rain cover 9.

The first housing 1, second housing 2, circuit board 21, fixing member 3, finishing member 4, LED module 5, bracket 6 and stand 7 are the same as in the first embodiment.

The rain cover 9 is installed at the first housing 1 so as to cover the first housing 1.

The rain cover 9 includes a supporting frame 91 and a cover member 92.

The supporting frame 91 is detachably installed at an upper portion of the first housing 1.

Detailedly, as shown in FIG. 15, the supporting frame 91 includes a fixing frame 911, and a rotating frame 912 which is hinged on both sides of the fixing frame 911 so as to be rotatable with respect to the fixing frame 911.

Therefore, as shown in FIG. 16, the supporting frame 91 can be rotated with respect to fixing frame 911 so as to be folded, while being separated from the first housing 1, and the captive screw W is coupled to lower portions of the fixing frame 911 and the rotating frame 912 hinged to both sides of the fixing frame 911 so that each supporting frame 91 can be detachably installed at the first housing 1.

The cover member 92 is coupled to an upper portion of the supporting frame 91 so as to cover upper, rear and both side surfaces of the first housing 1 except a front surface thereof.

The cover member 92 is formed of water-repellent cloth.

The rain cover 9 can be installed at the first housing 1 when a user shoots pictures outdoors on a rainy day or a day having wide daily temperature range, thereby protecting the lighting device. Further, since it has a foldable structure, it can be facilely stored and thus makes better use of a space when it is not used.

Other elements are the same as in the first embodiment, and thus the description thereof will be omitted.

INDUSTRIAL APPLICABILITY

As described above, since the present invention can be applied to the LED flat lighting device used in a small and medium imaging device for taking a picture or an image indoors or outdoors so that the heat generated from the LED module and circuit board is discharged to the outside through the convection part, it is possible to efficiently cool the lighting device.

While the present invention has been described with respect to the specific embodiments, it will be apparent to those skilled in the art that various changes and modifications may be made without departing from the spirit and scope of the invention as defined in the following claims.

The invention claimed is:

1. An LED flat lighting device, comprising:

an LED module emitting light toward a front side of the LED flat lighting device;

a first housing having a flat-shape spaced apart from the LED module at a rear side of the LED module, wherein an opening portion is disposed on a surface of the first housing;

a fixing member coupling the LED module and the first housing to each other;

a second housing disposed at a rear side of the first housing and covering the opening portion, wherein multiple radiation fins are disposed on an outer surface of the second housing;

a circuit board disposed within the second housing, spaced apart from the LED module, and controlling the LED module; and a light transmission cover disposed at a front side of the first housing and covering the LED module, wherein installing holes are disposed at an edge of the first housing, wherein the fixing member is inserted into the installing holes, wherein the fixing member comprises a coupling part coupled to the first housing; a first installing part protruded to a front side of the coupling part and inserted into one of the installing holes; and a second installing part protruded to a front side of the first installing part and inserted into another of the installing holes, wherein the LED module is installed at the first installing part and the light transmission cover is installed at the second installing part such that a convection part is formed between the LED module and the first housing and a heat generated from the circuit board and the LED module is transferred to the convection part, wherein radiation holes communicating the convection part with an outside of the first housing are disposed within the first housing such that the heat is discharged to the outside, and wherein radiation pads are disposed at the second housing and inserted into the opening portion such that the heat generated from the circuit board is transferred to the convection part.

2. The LED flat lighting device according to claim 1, further comprising a finishing member installed at each corner portion of the first housing.

3. The LED flat lighting device according to claim 2, wherein the finishing member is branched and protruded into two sections in order to form protrusions and inserting holes are formed at the corner portions of the first housing so as to be corresponding to the protrusions so that the protrusions are inserted therein respectively.

4. The LED flat lighting device according to claim 1, further comprising a stand coupled with the fixing member installed at both sides of the first housing by fastening members in order to stand the first housing, wherein slot-shaped coupling holes are disposed on the stand, and the fastening members are movably inserted into the slot-shaped coupling holes so as to fix the first housing to the stand.

5. The LED flat lighting device according to claim 4, wherein the stand is bent to cover an upper or lower portion of the first housing, and the stand has an oval shape in section, and reinforcing protrusions are disposed at the stand in a length direction of the stand.

6. The LED flat lighting device according to claim 1, further comprising a bandoor installed at the first housing in order to control a diffusion range of light emitted from the LED module, wherein the bandoor is fixed to the first housing by a captive screw.

7. The LED flat lighting device according to claim 1, further comprising a blade guide installed at the first housing and formed with one or more rail part opened in one direction; and a bandoor coupled to the rail part so as to control a diffusion range of light emitted from the LED module.

8. The LED flat lighting device according to claim 1, further comprising a bracket coupled with an adapter for supplying power to the circuit board and disposed at a rear side of the first housing, wherein a rivet is disposed at the first housing in which the bracket is installed, and one end of the bracket has a rivet groove formed between the first housing and the rivet, and another end of the bracket is fixed to the first housing by a captive screw.

9. The LED flat lighting device according to claim 8, wherein the bracket has a protruded part bent to wind a cable connected to the adapter.

10. The LED flat lighting device according to claim 1, further comprising a rain cover installed at the first housing so as to cover the first housing, wherein the rain cover comprises a supporting frame detachably installed at an upper portion of the first housing; and a cover member coupled to an upper portion of the supporting frame so as to cover upper, rear and both side surfaces of the first housing.

11. The LED flat lighting device according to claim 10, wherein the supporting frame is foldable in a state of being separated from the first housing, and the supporting frame comprises a fixing frame; and a rotating frame hinged to both sides of the fixing frame so as to be rotated with respect to the fixing frame.

* * * * *